United States Patent [19]

Fernstrom et al.

[11] 3,944,071

[45] Mar. 16, 1976

[54] FILAMENTARY TOW PACKAGE AND METHOD FOR MAKING

[75] Inventors: George Arvid Fernstrom, Seaford; James Richard Osborn, Jr., Wilmington, both of Del.

[73] Assignee: E. I. Du Pont de Nemours & Co., Wilmington, Del.

[22] Filed: Sept. 12, 1974

[21] Appl. No.: 505,493

[52] U.S. Cl. ..... 206/388; 28/21; 28/72 SP; 57/157 F

[51] Int. Cl.[2] B65D 85/00; B65H 54/84; D01H 7/92

[58] Field of Search ..... 206/388, 83.5, 525

[56] References Cited

UNITED STATES PATENTS

| | | | |
|---|---|---|---|
| 3,022,566 | 2/1962 | Daniels et al. | 242/166 |

FOREIGN PATENTS OR APPLICATIONS

| | | | |
|---|---|---|---|
| 1,329,972 | 9/1973 | United Kingdom | 206/83.5 |
| 19,562 | 6/1973 | Japan | 206/83.5 |
| 46,790 | 2/1973 | Japan | 206/83.5 |

*Primary Examiner*—Leonard Summer

[57] ABSTRACT

A filamentary tow package in which the tow is in layers of substantially vertical folds and has adjacent layers impacted with one another. Sections of the tow are twisted and vary in helix angle from greater than 45° in an S direction to greater than 45 degrees in a Z direction. The helix angle of the tow is increased by impacting it into layers of tow previously laid down.

3 Claims, 5 Drawing Figures

FILAMENTARY TOW PACKAGE AND METHOD FOR MAKING

BACKGROUND OF THE INVENTION

The invention concerns a filamentary tow package, more particularly, one in which the tow is laid down in layers of substantially vertical folds.

Filamentary tows are frequently stored in containers either between stages of spinning, drawing, crimping and cutting or for shipment to a customer. When a tow is deposited in such a container, either the container or the tow delivery device is generally moved in relation to one another so as to deposit the tow uniformly to fill all portions of the container in as level a layer as possible. Usually the speed of the tow is substantially greater than the relative motion between the tow delivery device and the container so that tow is forced to fold in some manner.

When tow is delivered into such a container at high speed, particularly at speeds of 400 yards a minute or greater, the tow is laid down in layers of substantially vertical folds which impact into the layers immediately below that have been previously deposited in the container. The impaction is random in nature so that certain portions of the tow are more tightly gripped than other portions. Thus, when the tow is removed from the can for further processing, the tension rises when the tightly impacted sections are being pulled loose. Furthermore, when one portion of the tow bundle is impacted with lower layers more tightly than the others, two portions of the bundle may split and move on to subsequent operations at different tensions, one portion being frequently so slack that it may drag on the floor when the bundle normally is supported on overhead guides. Also with severe impactions, the tow being removed from the container may pull out and carry along a portion of an adjacent fold and cause a condition referred to as a "tangle".

SUMMARY OF THE INVENTION

A tow package comprising a plurality of contiguous layers of multifilament tow, each layer having a plurality of substantially vertical folds, impacted with folds of adjacent layers, said tow having adjacent sections of opposite twist, each of said adjacent sections encompassing a length of less than 20 feet as measured along unfolded tow. More preferably, the average length encompassed by each section of opposite twist is less than 10 feet, as measured on the extended tow. Extended lengths of tow between sections of opposite twist having substantially zero twist are preferably less than 5 feet long.

The method for forming this unique tow package includes the step of applying alternate twist of a certain helix angle to the tow before it is fed into a container, then increasing that helix angle by impacting the tow into layers of tow previously laid down in the container.

DETAILED DESCRIPTION OF THE ILLUSTRATED EMBODIMENTS

Figure 1:
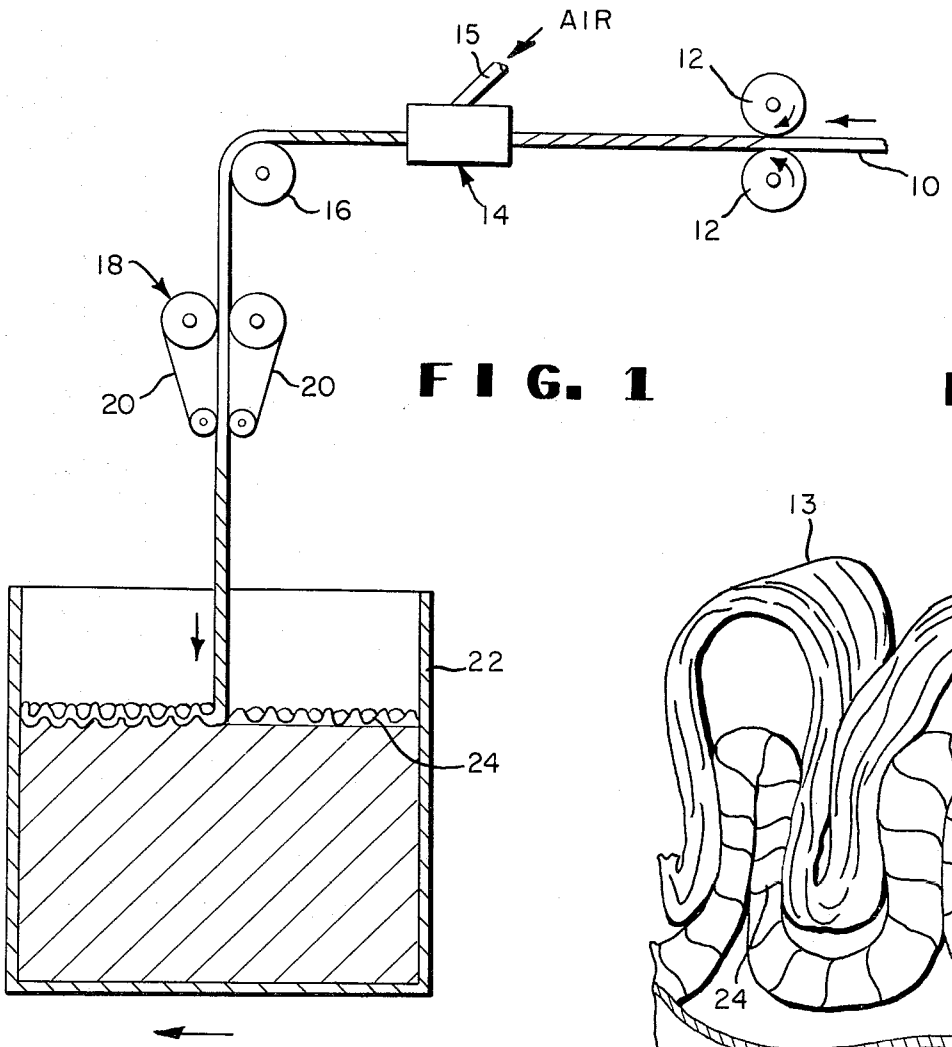
FIG. 1 shows one arrangement for making a product of the invention.

FIG. 1 shows a means of inserting alternate twist into a twistless tow then depositing the tow into a container. The tow may be drawn or undrawn. More particularly, tow 10 is advanced from a source (not shown) between a pair of driven rolls 12 which control the speed of the tow and also prevent twist from passing further back along the tow line. A fluid twisting device 14 located upstream of belt feeder 18 applies torque to the tow first in one direction and then the other, i.e., alternately twisted sections of S and Z twist with varying helix angles. The tow may then pass optionally over a change of direction roll 16 and pass in a downward direction through belt feeder 18 which includes a pair of belts 20 that are pressed against the tow to control the forwarding. The tow then passes downward into container 22 where it impacts into and among previous layers 24 of tow. Container 22 is generally rotated and/or traversed continuously at a speed considerably lower than that of the tow forwarding speed, i.e., at a speed about ⅓ to 1/20 that of the tow which may be in the range of from 400 to 1200 yards per minute. Alternatively, fluid twisting device 14 may be placed below belt feeder 18.

Figure 3:
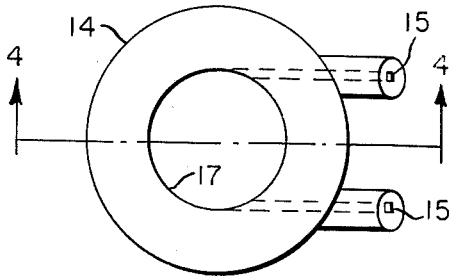
FIG. 3 is an end view of a fluid jet device suitable for applying alternate twist.
Figure 4:
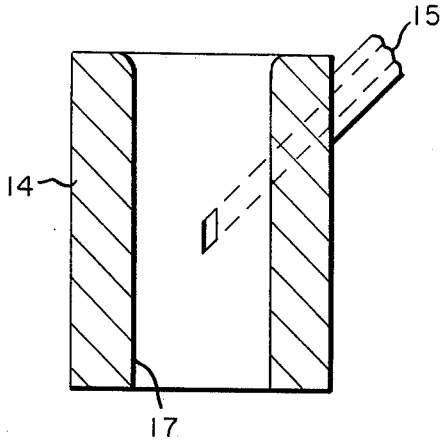
FIG. 4 is a cross-sectional view of the jet device of FIG. 3 taken on line 4—4.

FIGS. 3 and 4 show a fluid twisting device 14 in more detail. Internal bore 17 through which the tow passes has a diameter which is preferably 2 to 4 times the diameter of the compacted tow bundle. Air under pressure of 15 to 50 psi., preferably 20 to 40 psi., is fed alternately (30–180 cycles/minute) to two fluid passages 15 which are rectangular in shape and tangential to bore 17 where they meet bore 17. The air may be alternated by means of a spool or rotary valve, a mechanically actuated damper or other such device. For maximum effectiveness, the cross-sectional area of rectangular passage 15 where it intersects bore 17 should preferably be 1/12 to 1/20 of that of the cross-sectional area of bore 17. Passages 15 also are preferably angled at about 45° in the direction of tow movement.

Figure 2:
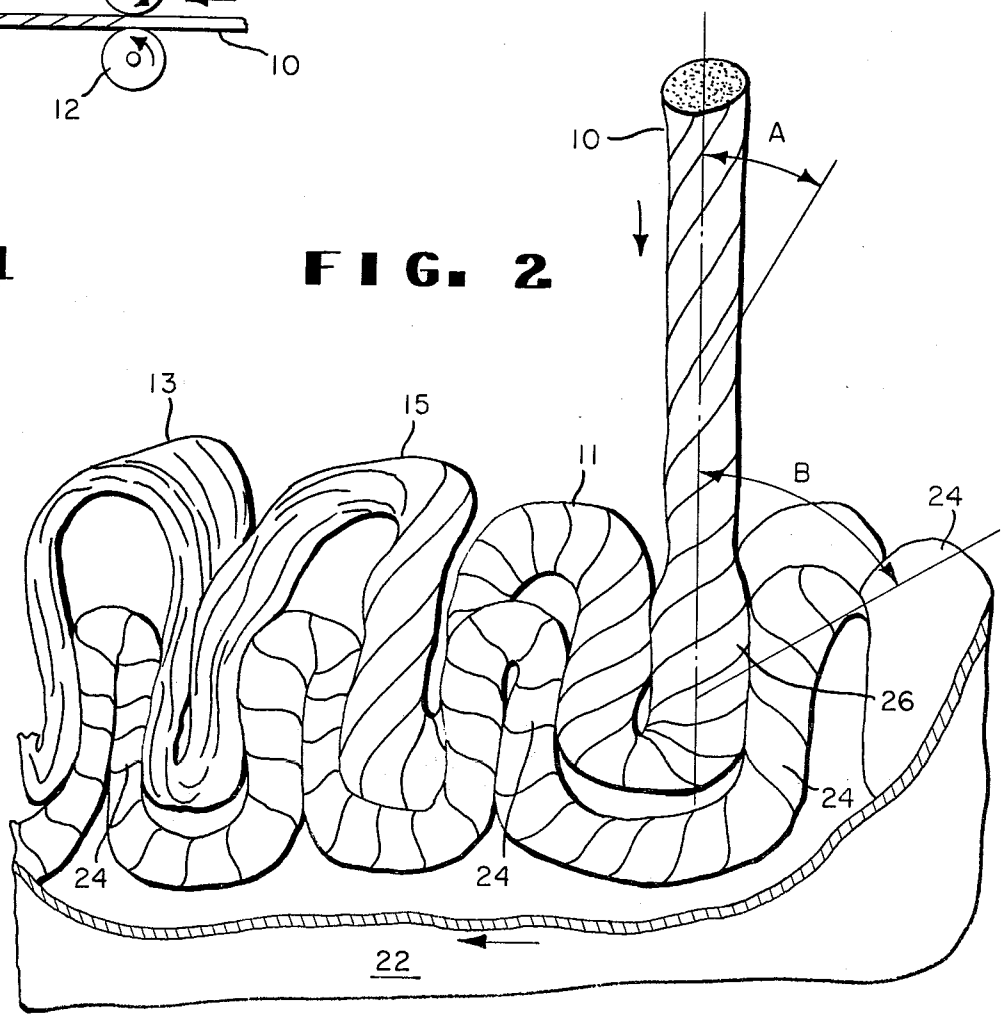
FIG. 2 is an enlarged view of an alternately twisted tow bundle impacting into another layer of tow to form the tow package of the present invention.

FIG. 2 shows twisted tow 10 having a helix angle A of about 30° feeding downward into a container to make a product of this invention. The container and the layer 24 of tow previously laid down is moved with respect to tow 10 as indicated by the arrow, the speed of such movement being substantially less than the downward forwarding speed of tow 10. When tow 10 impacts into the layer 24 of tow previously laid down, it collapses axially and tends to expand in diameter as shown at 26. Such axial collapse increases the helix angle to that shown by "B" which approaches 60°. This behavior is unique to a twisted bundle of a substantial helix angle and increases cohesion of the tow bundle. The twisted bundle still tends to maintain a generally rounded cross section. The loops 11 which project above the surface of tow layer 24 extend to a lesser height than loops 13 of an untwisted tow. Since this product is alternately twisted S and Z, there will be intermediate zones where there is little or no twist, such as 13. There, the tow bundle may occasionally form higher arch-like loops. Not all portions of the tow will be impacted; some portions such as 15 will lie randomly on the surface of previous layers 24.

In a product of the present invention, some portions of the tow may be laid somewhat randomly on lower layers of tow, but a distinguishing characteristic of an impacted laydown is that wherever portions of tow are substantially parallel to one another, they are approximately perpendicular to the tow surface in the container.

The twist characteristics of the tow in the container vary from high twisted sections of helix angle greater than 45° to low twist and zero twist at the reversal. The length of the highly twisted sections may vary. Even a short length of highly twisted section is effective in restricting tow entanglement to a manageable length. Zero twist lengths between twisted sections of opposite hand should preferably be less than 5 feet when measured in the extended state.

The improved delivery characteristics of tow from a container of this invention is attributed not only to the fact that the bundle cannot split at the highly twisted zones but also to the fact that the frequent occurrence of high twist sections limit the maximum length of defects which may be caused by separation of the bundle and entanglement in the low twist zones. Such limited lengths means that any difference in lengths or tensions between sections of the tow which such entanglements may cause will generally be corrected by the time that the tow enters the subsequent operation. On the other hand, high twist along the entire length of the tow would be a serious disadvantage because it would interfere with subsequent operations which perform better with parallel filaments. In the product of the present invention, twist reversals occur sufficiently frequently that zones of opposite hand cancel out and the tow is substantially twistless at the time it is removed from the container and is processed further.

In order for twist to cancel out, the length of each section of the most highly twisted zones of opposite hand is preferably less than the distance from the surface of the container to the first guide or other device through which the tow passes with a substantial change of direction or which tends to act as a twist trap, such as nip rolls, since this distance limits the twist cancellation. In most equipment arrangements, this maximum distance is the height of the ceiling, on the order of 10–20 feet. Therefore, the maximum length of each section of opposite twist is preferably 20 feet, more preferably 10 feet. The action of cancelling twist provides considerable rotary movement in the tow as it is removed from the container. This movement helps to disengage tangles, in addition to the action of binding the tow together which has been described previously. Excessively high degrees of twist or unnecessarily frequent reversals should be avoided if such twist is difficult to remove and tends to persist into subsequent operations.

Alternate fluid twisting has several advantages over mechanical twisting. Fluid can be reversed rapidly without inertia problems associated with mechanical devices. This is particularly important where, for example, if twist must be reversed every 10 feet on a tow running 1200 feet a minute, reversals must occur 2 times per second. Furthermore, mechanical twisting depends upon friction between the twisting device and the tow. Such friction acts primarily on the surface filaments, with consequent chance of damaging filaments. Fluid, on the other hand, opens the bundle as the fluid reverses and acts gently on a large portion of the bundle, thus providing maximum twisting action at the time that it is most needed.

In contrast to unidirectional continuous fluid false twisting, which puts a high degree of twist into the material during the twisting operation but which allows the false twist to cancel out almost immediately after leaving the twisting device, alternate opposite twisting can be controlled to insert a high degree of twist which will persist long enough to afford the temporary coherency described above. Furthermore, the reversals can be timed to assure that there will be two highly twisted zones of opposite hand within a desired length of tow.

One method of determining whether a product is of this invention is to remove the free end of tow vertically upward from the container 22 and place it over a guide or other device and to move the tow slowly upward by hand from the container. The tow is observed at the surface of the tow in the container just before it is tensioned, to determine whether sections of the tow are impacted approximately vertically within and among portions of tow below. If so, the helix angle ("B" in FIG. 2) is measured to determine whether the helix angle of the untensioned tow is greater than 45° and whether its direction is S or Z. The midpoint of the first section having a helix angle greater than 45° is encircled with a piece of tape. Additional tow is then removed from the container until the twist is seen to reverse and a helix angle greater than 45° in the opposite direction is observed in a section impacted approximately vertically. Another piece of tape is placed around the tow at the midpoint of this section. The procedure is repeated until 11 bands have been placed on the tow, then the distance between the bands is measured when the tow is in an extended state and the 10 distances are averaged. If the average of the 10 distances is less than 20 feet, or preferably less than 10 feet, then the tow package from which the tow was removed is a product of this invention.

Figure 5:
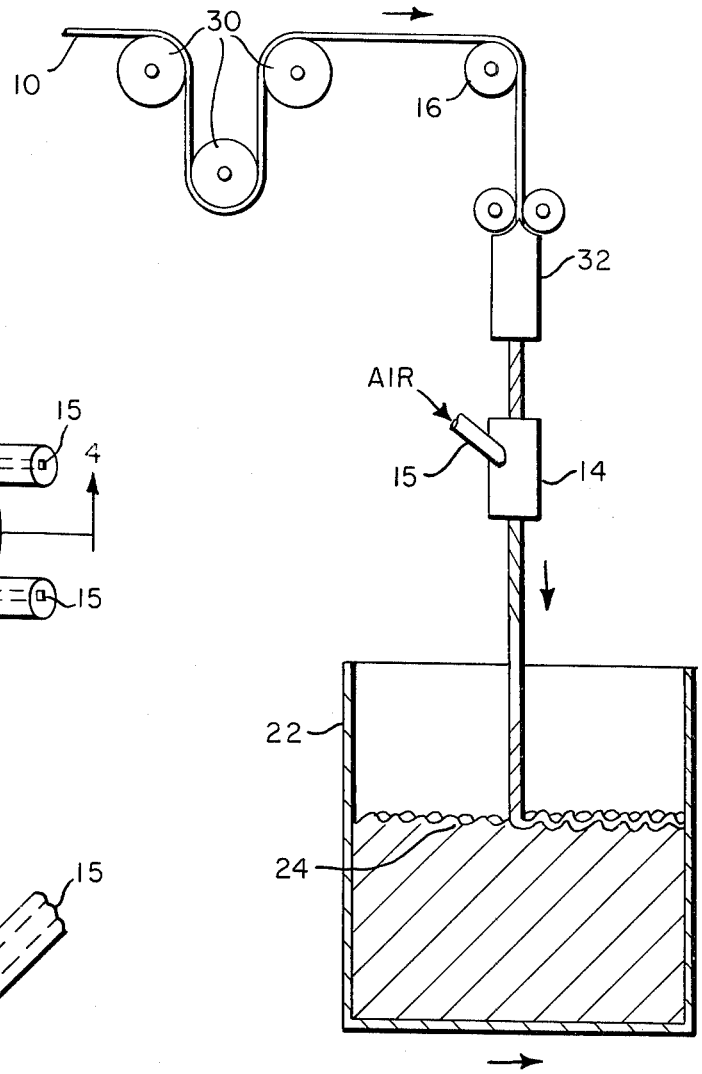
FIG. 5 is an alternate arrangement for making a product of the invention.

As an alternative to the arrangement shown in FIG. 1 for preparing the product of this invention, the advancing tow may be first crimped then have an alternate twist applied before being impacted into a container. For example, FIG. 5 shows untwisted and uncrimped tow 10 passing over speed control rolls 30 and change of direction roll 16 into stuffer crimper 32, where a sawtooth crimp is impressed on the tow filaments before being forwarded through twisting device 14 and impacted into container 22. Normally, the tow 10 in FIG. 5 is four times greater in cross section than tow 10 in FIG. 1 because the crimped tow is considerably larger than uncrimped tow and therefore requires a larger fluid twisting device although dimensional relationships of the twisting device are approximately the same. Larger volume and lower air pressure (0.5 to 3.0 inches of water), such as can be furnished by a blower, may be used because the crimped product has greater surface area per unit mass than uncrimped. Also it is desirable to avoid blowing the crimped tow apart and creating regions of varying bulk along the length of the tow.

What is claimed is:

1. A tow package comprising a plurality of contiguous layers of multifilament tow, each layer having a plurality of substantially vertical folds impacted with folds of adjacent layers, said tow having adjacent sections of opposite twist each of said adjacent sections encompassing a length of less than 20 feet as measured along unfolded tow, said adjacent sections of opposite twist being separated by sections of substantially zero twist, said sections of substantially zero twist being less than 5 feet long.

2. The tow package as defined in claim 1, said sections of opposite twist being alternate S and Z twist varying in helix angle from greater than 45° in the S direction to greater than 45° in the Z direction.

3. The tow package as defined in claim 2, said adjacent sections of opposite twist each encompassing a length of less than 10 feet.

* * * * *